US006594914B1

(12) United States Patent
Babcock

(10) Patent No.: US 6,594,914 B1
(45) Date of Patent: Jul. 22, 2003

(54) ICE SKATE BLADE SQUARING GAUGE

(76) Inventor: Kevin Babcock, 312 Valley View Dr., Endicott, NY (US) 13760

( * ) Notice: Subject to any disclaimer, the term of this patent is extended or adjusted under 35 U.S.C. 154(b) by 0 days.

(21) Appl. No.: 10/073,092

(22) Filed: Feb. 12, 2002

(51) Int. Cl.[7] ..... G01B 3/56
(52) U.S. Cl. ..... 33/535; 33/563
(58) Field of Search ..... 53/535, 501.45, 53/562, 563, 566, 555.2, 501.08

(56) References Cited

U.S. PATENT DOCUMENTS

| | | | | | |
|---|---|---|---|---|---|
| 337,224 | A | * | 3/1886 | Albert | 33/562 |
| 466,044 | A | * | 12/1891 | Jacobs | 33/539 |
| 2,191,105 | A | * | 2/1940 | Cutler et al. | 33/200 |
| 2,664,638 | A | * | 1/1954 | Storey | 33/562 |
| 3,730,631 | A | * | 5/1973 | Sreander | 356/150 |
| D268,253 | S | * | 3/1983 | Kennedy | D10/64 |
| 4,936,019 | A | * | 6/1990 | Hirsch | 33/562 |
| 5,253,427 | A | * | 10/1993 | Bartlett | 33/501.08 |
| 5,345,688 | A | | 9/1994 | Allen | |
| 6,481,113 | B1 | * | 11/2002 | Brenner et al. | 33/535 |

* cited by examiner

*Primary Examiner*—Diego Gutierrez
*Assistant Examiner*—Amy R. Cohen
(74) *Attorney, Agent, or Firm*—Salzman & Levy

(57) ABSTRACT

A blade squaring gauge for ice skates is in the form of a small, hand-held disk having the approximate size of a silver dollar. Along the circumferential edge of the disk are slots for truing the edges of the blade. Each slot corresponds to a different arc or curvature of the edge of the blade and provides squareness measurement at that position. A blade can be fitted into a given slot corresponding to the particular curvature on the peripheral blade surface and the squareness of the inner and outer edges of the blade is determined. The gauge eliminates the guesswork in determining trueness of the edge for given blade curvatures along the periphery of the blade.

16 Claims, 3 Drawing Sheets

ICE SKATE BLADE SQUARING GAUGE

FIELD OF THE INVENTION

The present invention relates to ice skates and, more particularly, to an ice skate blade squaring gauge for confirming accuracy in sharpening the blade.

BACKGROUND OF THE INVENTION

Ice blade squaring gauges are well known in the art. The ice skate blade surface has inner and outer edges, which must be squared and a major surface that has a predetermined arc or curvature. These edges influence how the skater leans into, turns or otherwise maintains his or her balance upon the skates. All too often, the blade edges become worn with respect to each other. In such circumstances, the skater is caused to exert more force to the inside or outside, as the case may be, in order to maintain proper balance.

Moreover, the longitudinal or major, lowermost edge of the blade has a predetermined curvature that is optimized as a function of the skater's experience, desired use (e.g., recreational skater, racing skater, figure skater), weight and model of skate. Such curvature is generally identified by diameter of an imaginary circle having a corresponding diameter (e.g., ⅜", ¾", ½", 1").

In the past, edges were often machined, filed, or ground true using crude visual observation. The problem with truing the inner and outer edges is complicated by the curvature of the skating blade. The perpendicularity of the edges of the blade is not easily trued as the blade curves, because the radius of the curvature greatly influences the line of sight.

More recently, however, devices for measuring or truing the inner and outer surfaces have been developed. One such device is illustrated in U.S. Pat. No. 5,345,688, issued to Robert H. Allen on Sep. 13, 1994, entitled METHOD AND DEVICE FOR MEASURING SQUARENESS OF ICE SKATE BLADES. As will be observed from the reading of this patent, the method and device are rather complex. The individual must first establish a standard line generally perpendicular to the side of the ice skate blade. Then two sets of graduations are developed about the standard line. Then a squaring line is developed, which is based on the perpendicularity of the side of the blade and an edge thereof. Then the squaring line is visually compared to the standard line and the graduations are used to determine the value of squareness of the edge.

What is needed is a more simple, convenient mechanism or device for accomplishing verification of blade sharpening.

The present invention reflects the discovery of a device and method of squaring ice skate blades that is simple and that easily compensates for the curvature's influence upon the line of sight when truing the edges.

SUMMARY OF THE INVENTION

In accordance with the present invention, there is provided a gauge for ice skate blades, which allows for squaring the edges along the entire blade surface. The gauge is a small, hand-held, truing article, which easily fits upon a key ring or within one's pocket. The gauge is approximately the size and shape of a silver dollar and has a number of truing slots that are cut into the edge of the outer circumference. Each of the slots is distanced from the center of the gauge with a given distance corresponding to a given curvature position upon the periphery of the blade. The various radii of the curvature of different blades are machined into, or embossed upon, the obverse surface of the gauge adjacent each slot so that the individual knows which slot to use. The blade is fitted into a given slot corresponding to the particular position on the peripheral blade surface and the squareness of the inner and outer edges of the blade is determined. These slots take the guesswork or supposition from trying to visually determine the squareness of the edges relative to the curvature of the blade. The blade is fitted into a given slot corresponding to the particular position on the peripheral blade surface, and the squareness of the inner and outer edges of the blade can be confirmed. Therefore, the edges can be easily trued with respect to each other, along the entire blade surface. Included in the plurality of slots is a squaring slot relative to the straight surface of the blade.

It is an object of the present invention to provide a truing gauge for easily determining the squareness of the edges of an ice skate blade.

It is another object of this invention to provide a squaring gauge for the edges of an ice skate blade that is both simple to manufacture and easy to use.

BRIEF DESCRIPTION OF THE DRAWINGS

A complete understanding of the present invention may be obtained by reference to the accompanying drawings, when considered in conjunction with the subsequent detailed description, in which.

For purposes of brevity and clarity, like components and elements of the apparatus of this invention, will bear the same designations or numbering throughout the figures.

DESCRIPTION OF THE PREFERRED EMBODIMENT

Generally speaking, the invention features a blade squaring gauge for ice skates. The gauge comprises a small, hand-held disk having the approximate size of a silver dollar. Along the circumferential edge of the disk are slots for truing the edges of the blade. Each slot corresponds to a predetermined arc or curvature of the tip of an ice skate blade, and provides squareness measurement at that position. The blade is fitted into a given slot corresponding to the desired blade curvature on the peripheral blade surface and the squareness of the inner and outer edges of the blade is determined. The gauge eliminates the guesswork in determining trueness of the edge along the periphery of the blade.

Figure 1:
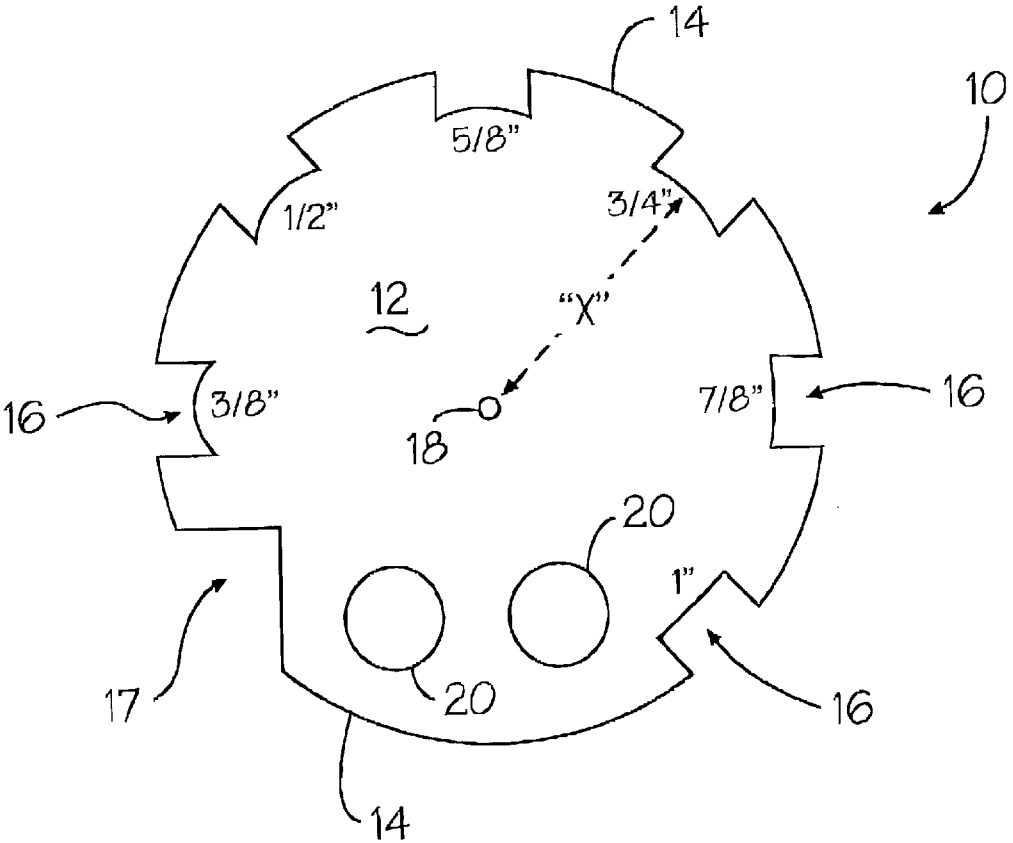
FIG. 1 illustrates a front view of an obverse surface of an ice skate blade-squaring gauge of this invention.
Figure 2:
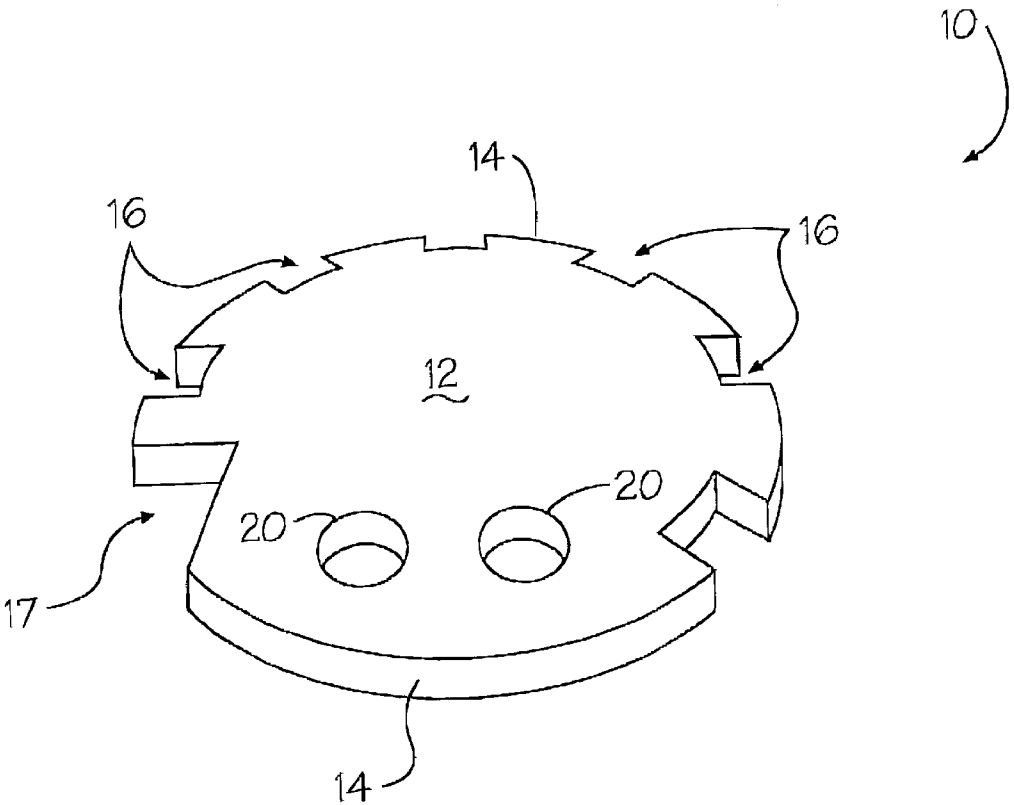
FIG. 2 depicts a perspective view of the ice skate blade squaring gauge shown in FIG. 1.

Now referring to FIGS. 1 and 2, an ice skate blade squareness gauge 10 is illustrated. The squareness gauge 10 is comprised of a small, hand-held disk 12 having the approximate size of a silver dollar. Along the circumferential edge 14 of the disk 12 are positioned a number of spaced-apart slots 16 for truing the inner and outer edges of an ice skate blade (not shown) along its periphery. Each slot 16 corresponds to an edge position having a different curvature of the blade and provides squareness measurement at that position. Thus, there is no need to use a plurality of gauges for a plurality of curvatures. The gauge 10 eliminates the guesswork in determining trueness of the edge at a given curvature along the curvature of the blade.

Each slot 16 is configured as if it were a portion of the circumference of a circle having a predetermined radius. For purposes of this description, an imaginary distance "X" is depicted in FIG. 1 to indicate the radial distance from the origin 18 of the respective imaginary circle origins. Note that markings are placed proximate each slot 1*b* to indicate the diameter of each respective, imaginary circle. For example, the slot 16 indicating ¾" represents an arc of a circle having a ¾" diameter.

Each slot 16 is numbered on the obverse surface of the disk 12 with its corresponding curvature, as shown in FIG. 1. The fractional numbering appearing adjacent each slot 16 can be machined or embossed into the obverse surface. A square-edged slot 17 is disposed at the left hand side of the disk 12 and corresponds to the right angled portion of the ice skate blade periphery. The blade is fitted into a given slot corresponding to the particular position on the peripheral blade surface and the squareness of the inner and outer edges of the blade is determined.

Holes 20 are designed to receive the ends of the skate laces (not shown) in order to repair them when the retaining clip becomes worn, damaged, or fall off. Placing the fibrous ends of each lace in holes 20 concentrates and gathers in the loose end fibers, which can be glued together. After gluing, a new retaining clip can be fitted to the end of the laces.

Figure 1A:
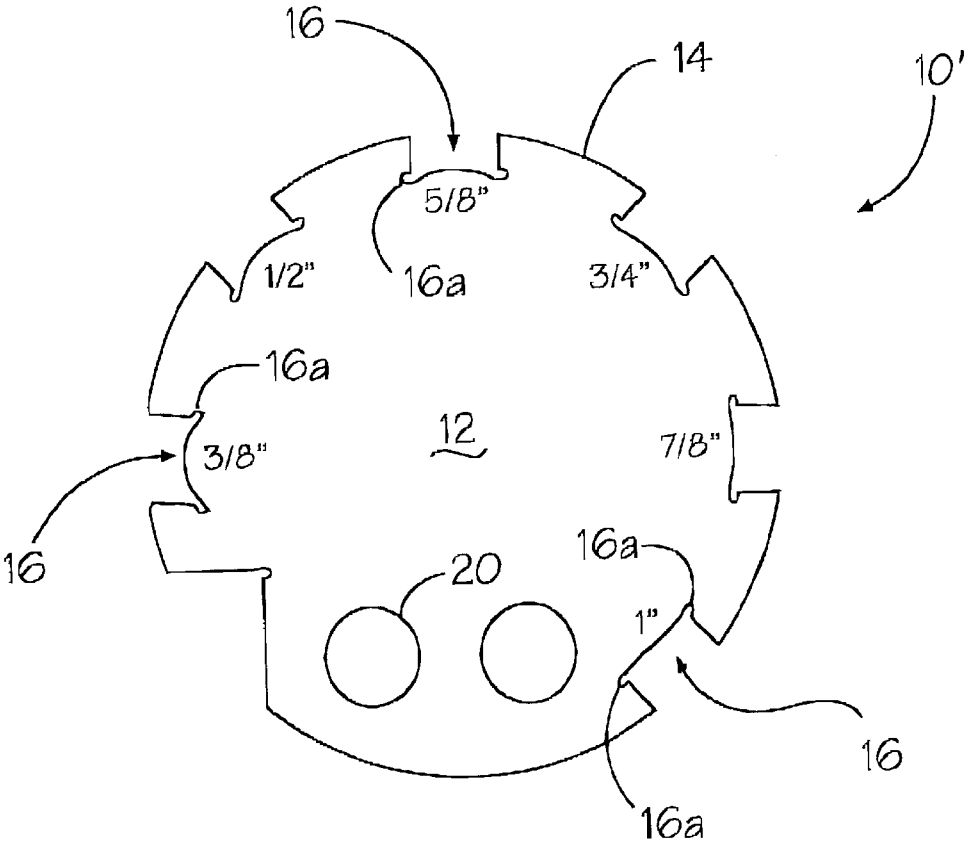
FIG. 1*a* illustrates a front view of an alternate embodiment of the ice skate blade squaring gauge of the invention.

Referring now to FIG. 1*a*, a gauge 10' can also be produced with a cutout 16*a* on each side of slots 16 to provide stress relief during the manufacture of disk 12.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A gauge for determining squareness of edges of an ice skate blade along a periphery of the blade, comprising: a generally circular, free-standing body having a uniform thickness and having a plurality of spaced-apart apertures disposed upon a peripheral edge thereof, each of said plurality of spaced-apart apertures corresponding to a respective curvature position on an ice skate blade periphery, each of said apertures adapted to receive a blade to determine squareness and curvature among inner, outer and longitudinal edges of a blade at a corresponding curvature position.

2. The gauge in accordance with claim 1, wherein said generally circular body comprises a disk.

3. The gauge in accordance with claim 1, wherein each of said spaced-apart apertures comprises a spaced-apart slot.

4. The gauge in accordance with claim 3, wherein each of said spaced-apart slots is configured with a different arc or curvature.

5. The gauge in accordance with claim 3, wherein each of said spaced-apart slots is configured with a different arc or curvature.

6. The gauge in accordance with claim 1, further comprising at least one aperture disposed within said circular body for repair of shoelaces.

7. A gauge for determining squareness of inner, outer and longitudinal edges of an ice skate blade along a periphery of the blade, comprising: a generally circular, free-standing disk having a uniform thickness and having a plurality of spaced-apart apertures disposed upon a peripheral edge thereof, each of said plurality of spaced-apart slots corresponding to a respective curvature position on an ice skate blade periphery, each of said slots receiving an ice skate blade to determine squareness among said inner, outer and longitudinal edges of said ice skate blade at a corresponding curvature position.

8. The gauge in accordance with claim 7, wherein each of said spaced-apart slots is configured with a different curvature.

9. The gauge in accordance with claim 7, further comprising at least one aperture disposed within said circular body for repair of shoelaces.

10. A gauge for determining squareness of inner and outer edges of an ice skate blade along a periphery of the blade, comprising: a generally circular, free-standing disk having a uniform thickness and having a plurality of spaced-apart slots disposed upon a peripheral edge thereof, each of said plurality of spaced-apart slots configured with a predetermined curvature, each of said slots adapted to receive a blade to determine squareness between said inner and outer edges of a blade.

11. The gauge in accordance with claim 10, wherein each of said spaced-apart slots is configured with a different curvature.

12. The gauge in accordance with claim 10, further comprising at least one aperture disposed within said circular body for repair of shoelaces.

13. A gauge for determining squareness of inner and outer edges of an ice skate blade along a periphery of the blade, comprising: a generally circular, free-standing disk having a uniform thickness and having a plurality of spaced-apart slots disposed upon a peripheral edge thereof, each of said plurality of spaced-apart slots having a respective curvature, each of said slots adapted to receive a blade to determine squareness between said inner and outer edges of a blade and a corresponding curvature of the longitudinal edge, and wherein each of said slots comprises an individual designation disposed upon an obverse surface of said disk.

14. The gauge in accordance with claim 13, further comprising at least one aperture disposed within said circular body for repair of shoelaces.

15. The gauge in accordance with claim 13, wherein one of said spaced-apart slots comprises a right-angled slot.

16. The gauge in accordance with claim 13, wherein each designation indicates a radial curvature.

* * * * *